US007428893B2

(12) United States Patent
Shinogle et al.

(10) Patent No.: US 7,428,893 B2
(45) Date of Patent: Sep. 30, 2008

(54) ELECTRONIC FLOW CONTROL VALVE

(75) Inventors: Ronald D. Shinogle, Peoria, IL (US); William J. Rodier, Metamora, IL (US); James D. Peltier, Lafayette, IN (US); Udo Schlemmer-Kelling, Molfsee (DE); Juergen Nagel, Gettorf (DE)

(73) Assignee: Caterpillar Inc, Peoria, IL (US)

( * ) Notice: Subject to any disclaimer, the term of this patent is extended or adjusted under 35 U.S.C. 154(b) by 75 days.

(21) Appl. No.: 10/988,141

(22) Filed: Nov. 12, 2004

(65) Prior Publication Data

US 2006/0102152 A1 May 18, 2006

(51) Int. Cl.
*F02D 17/04* (2006.01)
*F02M 63/00* (2006.01)

(52) U.S. Cl. ..... 123/481; 123/198 DB; 123/198 F

(58) Field of Classification Search ..... 123/198 D, 123/198 F, 198 DB, 446, 447, 456, 479, 481; 73/118.1, 199 A
See application file for complete search history.

(56) References Cited

U.S. PATENT DOCUMENTS 3,851,635 A * 12/1974 Murtin et al. ..... 123/478
4,020,814 A * 5/1977 Hewitt et al. ..... 123/198 DB
4,024,850 A * 5/1977 Peter et al. ..... 123/198 DB
4,408,587 A 10/1983 Wissmann
4,423,709 A * 1/1984 Arrieta ..... 123/198 F
4,492,191 A 1/1985 Aoki et al.
4,499,876 A * 2/1985 Yamamoto ..... 123/446
4,539,959 A 9/1985 Williams
4,590,768 A 5/1986 Halvorsen et al.
4,777,921 A 10/1988 Miyaki et al.
4,967,727 A * 11/1990 Takahashi et al. ..... 123/481
5,105,779 A 4/1992 Thompson
5,433,182 A * 7/1995 Augustin et al. ..... 123/456
5,511,528 A * 4/1996 Iwanaga et al. ..... 123/198 DB
5,813,383 A 9/1998 Cummings
5,816,220 A * 10/1998 Stumpp et al. ..... 123/198 DB
5,864,055 A * 1/1999 Borrione et al. ..... 73/118.1

(Continued)

FOREIGN PATENT DOCUMENTS

DE 019719631 A1 * 9/1998

(Continued)

OTHER PUBLICATIONS

Juha Kytola; Success of Wartsila And Sulzer Common Rail Engines; Engine Technology (4-stroke), Wartsila Corporation, and Klaus Heim, Engine Technology (2-stroke); pp. 27-30; Wartsila Switzerland Ltd.

(Continued)

*Primary Examiner*—T. M. Argenbright
(74) *Attorney, Agent, or Firm*—Liell & McNeil

(57) ABSTRACT

An internal combustion engine is provided that includes a high pressure feed line, and a plurality of fuel injectors fluidly connected to the high pressure feed line, each being operable to inject a fuel into the engine. The engine further includes an electronically controlled flow disabler disposed between the high pressure feed line and each one of the fuel injectors. Each of the flow disablers includes an actuator operable to move a valve member toward a closed position at which the flow disabler blocks a fuel flow to the respective fuel injector.

16 Claims, 1 Drawing Sheet

U.S. PATENT DOCUMENTS

| | | | | |
|---|---|---|---|---|
| 5,868,116 | A | 2/1999 | Betts et al. | |
| 6,273,066 | B1 * | 8/2001 | Frankle et al. | 123/446 |
| 6,360,724 | B1 | 3/2002 | Suhre et al. | |
| 6,405,705 | B1 | 6/2002 | Dunsworth et al. | |
| 6,532,938 | B1 | 3/2003 | Mahr et al. | |
| 6,564,616 | B2 * | 5/2003 | Antonioli et al. | 73/119 A |
| 6,622,487 | B2 | 9/2003 | Jones | |
| 6,718,944 | B2 | 4/2004 | Franke et al. | |
| 6,840,268 | B2 * | 1/2005 | Kennedy et al. | 123/446 |
| 6,918,379 | B2 * | 7/2005 | Reischl et al. | 123/480 |

FOREIGN PATENT DOCUMENTS

| | | | |
|---|---|---|---|
| EP | 0 899 444 | A2 | 3/1999 |
| JP | 2001073852 | A * | 3/2001 |
| JP | 2003-293891 | * | 10/2003 |

OTHER PUBLICATIONS

Kaspar Aeberli; Building The Largest Common-Rail Engines; May 2004; Wartsila Corporation; pp. 1-11; Warsila Switzerland.

* cited by examiner

ELECTRONIC FLOW CONTROL VALVE

TECHNICAL FIELD

The present disclosure relates generally to internal combustion engines, and relates more particularly to an internal combustion engine including an electronically controlled flow disabler to selectively block a fuel flow to at least one fuel injector of the engine.

BACKGROUND

Internal combustion engines are used as power sources in virtually every conceivable environment. Motorcycles, passenger cars, airplanes, locomotives and ships may all utilize internal combustion engines for propulsion and/or powering of various onboard devices. Generators and power stations may also use a variety of internal combustion engines for production of electrical power. Internal combustion engines can range in size from small engines designed for powered hand tools, to engines approaching the size of a single family home. Over the last century, internal combustion engines have been widely used in relatively large freighters and barges, replacing coal-fired steamers of the 1800's. These and similar internal combustion engines tend to be quite large to provide sufficient power for driving, turning and slowing the massive ships.

Once a relatively large internal combustion engine is started, it is generally undesirable to shut it down unless absolutely necessary, for example for servicing or to avoid a catastrophic engine failure. In marine applications, the reasons for this are at least twofold. First, it can be quite labor intensive to actually start a massive internal combustion engine. Second, enormous vessels can have enormous momentum, and may need powerful reverse or lateral thrust to slow down or turn in a reasonable time, such as when entering port. The ability to reverse propellers, or activate lateral propulsion can also be critical to avoiding collisions.

While maintaining continuous engine operation can be critical, problems with engine operation can seldom be ignored. For example, where a malfunction in one or more of the engine cylinders is detected, attempts to continually operate the engine can result in damage to the affected cylinder(s) and associated components or, worse, catastrophic engine failure. In the latter case, further operation of the engine will be obviously impossible, and no benefit inheres from foregoing shutdown.

Although engineers and operators typically undertake extensive engine diagnostic and maintenance routines, large internal combustion engines can take a significant beating. For example, large marine engines often operate continuously for many hours between maintenance and shutdown. Compounding the operating demands of such engines is the common use of relatively heavy, viscous fuels.

The fuel quantities required to drive a supertanker thousands of miles, for example, are understandably enormous. In an effort to reduce operating costs, many vessel operators find it advantageous to be able to run their engines on not only distillate diesel fuel, but also other relatively inexpensive, residual petroleum fuels. Thus, many marine engines have the capability to switch between a relatively refined fuel such as diesel, and less or non-refined, heavier fuels, often referred to in the industry as residual petroleum fuel. The engine might burn primarily diesel in higher traffic areas or while in port, for example, and might burn the residual fuel primarily while travelling on the high seas. The relative costs of the two fuel types, and local regulations may also affect the decision as to which fuel type to use.

Given the desired flexibility to burn multiple fuel types, the aforementioned marine engines are generally equipped with at least two separate fuel tanks, and various valves and plumbing to apportion the fuel flow from the two tanks as desired. Such systems also often use a common rail or similar fuel delivery system. A typical common rail design includes a pressurized rail or supply line, with a plurality of fuel injectors fluidly connected thereto. Each of the injectors is generally actuated to deliver a measured spray of fuel to an associated cylinder of the engine via one or more fuel injection control valves.

Such systems are also often equipped with various means for limiting overspray or excess fuel flow to the engine cylinders, which can disrupt engine operation and potentially cause engine damage. One such mechanism is known in the art as a mechanical flow limiter. Mechanical flow limiters generally include one or more hydraulically movable components operable to limit or block a fuel flow to one or more engine cylinders, generally following an injection event.

The relatively small, hydraulically sensitive components of a mechanical flow limiter are generally sized and/or designed based at least in part on an approximate viscosity of the fuel flowing therethrough. Accordingly, a mechanical flow limiter design well suited to a relatively lighter, less viscous petroleum distillate such as diesel may not function as well, or at all when used in a system burning a relatively more viscous residual fuel. Residual fuels tend in fact to be so viscous that they must be heated prior to reaching a flowability suitable for delivery via a pressurized supply line and injection through a fuel injector.

The present disclosure is directed to one or more of the problems or shortcomings set forth above.

SUMMARY OF THE INVENTION

In one aspect, the present disclosure provides an internal combustion engine. The internal combustion engine includes a high pressure feed line, and a plurality of fuel injectors fluidly connected with the high pressure feed line. Each of the fuel injectors are operable to inject fuel into a cylinder of the engine. The engine further includes an electronically controlled flow disabler disposed between the high pressure feed line and a fuel injection control valve of each of the plurality of fuel injectors. Each of the flow disablers includes an actuator operable to move a valve member toward a closed position at which the flow disabler blocks a fuel flow to the respective fuel injector.

In another aspect, the present disclosure provides a method of operating an internal combustion engine. The method includes the steps of injecting a fuel from a high pressure feed line to a plurality of engine cylinders via respective fuel injection control valves of respective fuel injectors, and disabling at least one of the engine cylinders upon the detection of a fault by selectively actuating an electronically controlled flow disabler to block a fuel flow thereto.

DETAILED DESCRIPTION

Figure 1:
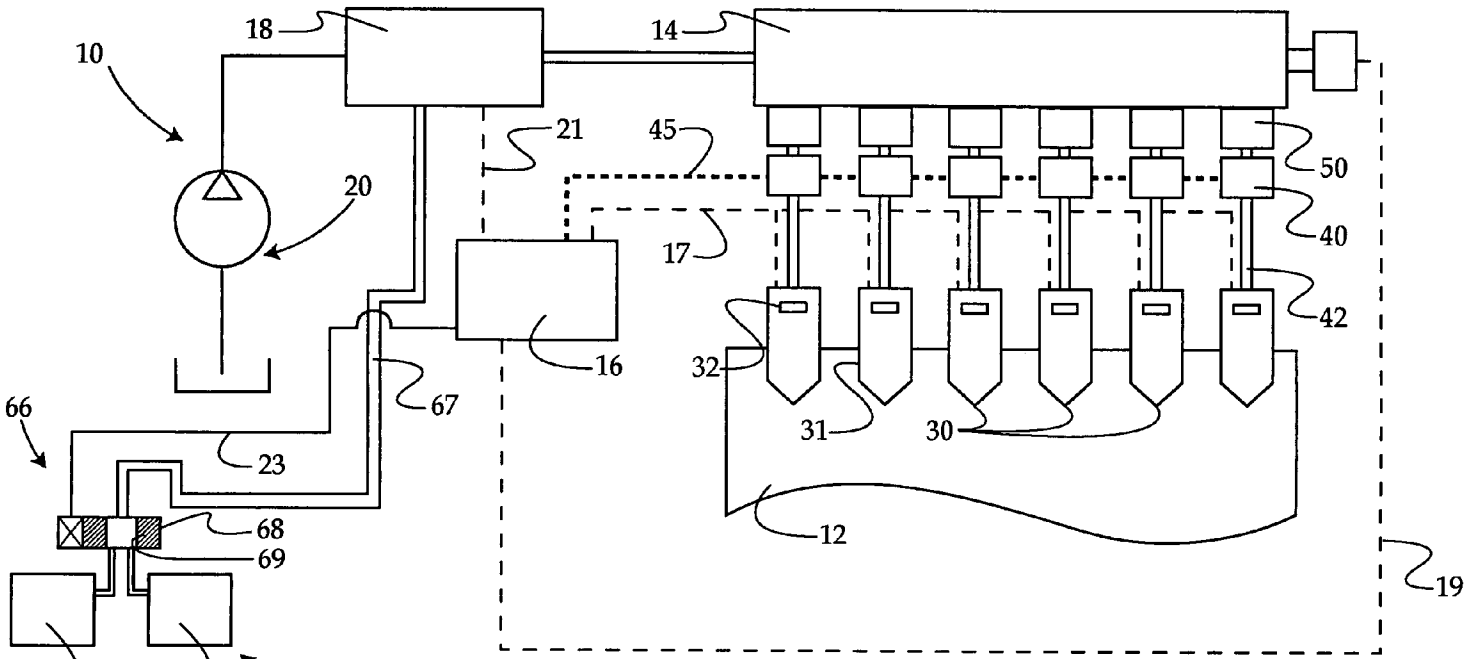
FIG. 1 is a schematic view of an engine according to present disclosure.

Referring to FIG. 1, there is shown an engine 10 according to the present disclosure. Engine 10 includes an engine housing 12, and a plurality of fuel injectors 30 operable to inject a fuel therein. Each of fuel injectors 30 is fluidly connected to a high pressure feed line 14 via supply passages 42, and is preferably an injector of the type having at least one fuel injection control valve housed. High pressure feed line 14, preferably a common rail, is preferably fluidly connected to one or more high pressure pumps 18, which are in turn preferably connected to a low pressure drain 20 and a fuel supply 60. It is contemplated that engine 10 will be primarily applicable to relatively large marine propulsion systems, for example, powering one or more propellers via a drive shaft. It should be appreciated that engine 10 is not limited to such an application, however, and might alternatively be used in a land vehicle such as a truck or locomotive, or in powering an electrical generator, for example.

Fuel supply 60 preferably includes a first fuel tank 62 and a second fuel tank 64. Each of tanks 62 and 64 preferably contains a different type of fuel including, for example, a petroleum distillate fuel such as diesel in one of tanks 62 and 64 and another fuel such as a residual petroleum fuel in the other of tanks 62 and 64.

A control valve 66 is preferably disposed in a fuel supply line 67 that connects fuel supply 60 with high pressure pumps 18, and operable to selectively fluidly connect either or both of fuel tanks 62 and 64 with supply line 67. Control valve 66 may include, for example, a movable valve member 68 having an internal passage 69. A position of valve member 68 may be adjusted to selectively connect only one of tanks 62 and 64 with supply line 67 or, alternatively, valve member 68 might be positioned such that passage 69 fluidly connects both of fuel tanks 62 and 64 with supply line 67 simultaneously. The latter case is preferably used to facilitate a relatively smooth changeover of fuel types, allowing a mixture thereof to be temporarily supplied to high pressure feed line 14 rather than abruptly switching from one fuel type to another.

An electronic control module 16 is preferably included with engine 10, and is in control communication with various components thereof. Control module 16 preferably communicates with the fuel injection control valves 32 of each of fuel injectors 30 via a communication link 17 to electronically actuate the same during engine operation. Control module 16 is likewise in communication via a second communication link 45 with electronically controlled flow disablers 40, and with high pressure pumps 18 via a third communication link 21. In a preferred embodiment, control module 16 is operable to monitor a plurality of engine operating parameters, including engine speed, pressure of feed line 14 via communication line 19, high pressure pump speed, requested injector output and timing, exhaust content and temperature, etc., in a conventional manner. A fourth communication link 23 may be provided between fuel supply 60, in particular control valve 66, and control module 16, allowing fuel levels, valve position, fuel temperature, etc. to also be monitored.

Figure 2:
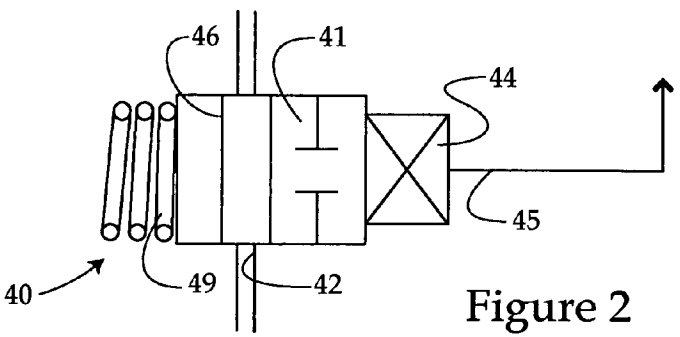
FIG. 2 is a diagrammatic view of an electronically controlled flow disabler according to the present disclosure.

Control module 16 is further preferably in control communication with a plurality of electronically controlled flow disablers 40, operable independently of the fuel injection control valves 32 in fuel injectors 30. Referring also to FIG. 2, there is shown schematically a flow disabler 40 suitable for use with engine 10. Each flow disabler 40 is preferably disposed in each fuel supply line 42 between one of fuel injectors 30 and high pressure feed line 14. Flow disablers 40 are operable to block a fuel flow through one of lines 42 such that the fuel flow through that line to engine 10, typically to a cylinder thereof, will be blocked.

In a preferred embodiment, each of flow disablers 40 includes a valve member 41 having an internal passage 46. Each valve member 41 is preferably normally biased to an open position such that fuel can freely flow through line 42 to reach the respective injector 30. An actuator 44 is preferably coupled with each flow disabler 40 and is operable to move the respective valve member 41 toward a closed position upon an appropriate command from control module 16. Biasing means, for example a biasing spring 49 is preferably disposed adjacent valve member 41 to bias the same toward an open position, as shown in FIG. 2.

Those skilled in the art will appreciate that the described electronically controlled flow disabler 40 is exemplary only, and significant modifications might be made to the presently disclosed embodiments without departing from the scope of the present disclosure. For example, valve member 41 need not be biased toward an open position at all. Rather than biased open, valve member 41 could be biased toward a closed position and a releasable mechanical or hydraulic lock might be employed to keep valve member 41 open, then released upon a signal from control module 16 or an operator. Similarly, actuation of each flow disabler 40 might take place by a wide variety of means. For instance, pneumatic or electrical systems might be used, or a pilot operated or non-pilot operated hydraulic actuator to actuate valve member 41. In the preferred embodiment, the electronically controlled flow disablers simply have an electrical actuator operably coupled to a valve member that is normally biased to an open position via a biaser, such as a spring. Next, in the preferred embodiment, the flow disabler is actuated to a closed position by energizing an electrical actuator. The present disclosure also contemplates flow disablers that are normally actuated to a closed position via a biaser, such as a spring, but may be moved to an open position by energizing an electrical actuator. Thus, as used in this patent, the term actuate takes on its normal definition in that that term means moving something from one position in another, which may be done directly or indirectly by either energizing or de-energizing a separate electrical actuator.

A plurality of mechanical flow limiters 50 are also preferably provided, and are preferably positioned in series, one with each one of electronically controlled flow disablers 40, either upstream or downstream with respect to feed line 14. In a preferred embodiment, mechanical flow limiters 50 are operable to limit or block, most preferably block, a fuel flow via supply lines 42 to the respective fuel injector 30. Numerous suitable designs are known for mechanical flow limiters 50, typically including a hydraulically movable member operable to halt fuel flow, as is well known in the art.

INDUSTRIAL APPLICABILITY

Operation of engine 10 is initiated typically by pressurizing fuel with high pressure pumps 18, and supplying the same to feed line 14. Pressurized fuel can then be supplied via supply lines 42 to each of fuel injectors 30, and injected to fire the engine cylinders as desired, the injection timing typically being electronically controlled with control module 16. Typically, engine start up will take place with diesel or another petroleum distillate fuel from one of tanks 62 and 64. At a desired time, control valve 66 may be actuated to begin a changeover of fuel types by switching between fuel from one of tanks 62 and 64 to fuel from the other of tanks 62 and 64. Fuel changeover preferably takes place relatively gradually by moving valve member 68 to an intermediate position such that fuel can flow from both of tanks 62 and 64 to supply line 67 simultaneously. After a desired length of mixing time, valve member 68 can be moved toward a position at which only one of tanks 62 and 64 connects with supply line 67, and only a single fuel type powers engine 10. Where one of the fuel types is a residual fuel, a heating system (not shown) is preferably used to heat the residual fuel and reduce a viscosity thereof to a point at which the residual fuel may be delivered to and injected by injectors 30.

In a preferred embodiment, electronic control module 16 includes a computer readable medium having a control algorithm recorded thereon. The control algorithm preferably includes means for monitoring an engine speed and operation of injectors 30. Various other engine operating parameters may be monitored and/or controlled with the control algorithm. In a preferred embodiment, a second control algorithm is preferably recorded on the computer readable medium, and includes means for selectively actuating one or more of flow disablers 40 to block a fuel flow to the associated cylinder(s) upon detection of a fault.

Engine 10 may include a variety of sensors operable to detect a fault condition associated with one or more of the engine cylinders. Such sensors might include, for example, combustion noise sensors operable to detect a change in the combustion characteristics of one or more cylinders, or pressure sensors operable to detect an unexpected change in fuel pressure at various points throughout the fuel system. Various electrical characteristics of the individual fuel injectors may also be monitored by sensors. Many hydraulically actuated fuel injectors, such as the preferred injectors employed in engine 10, include numerous small, relatively complex internal moving parts. The relatively viscous residual petroleum fuel preferably used in an engine such as engine 10 can occasionally clog the internal injector parts and plumbing. In such a situation, continued operation of the cylinder associated with that injector is undesirable. Disabling of one or more of the cylinders of engine 10 will therefore typically occur during engine operation with residual fuel, although the present disclosure is by no means so limited.

Electronic control module 16 is preferably configured to receive a fault signal from one or more of the engine sensors. The second control algorithm recorded on the computer readable medium preferably includes means for energizing (or de-energizing) one or more electrical actuators of flow disablers 40 upon detection of the fault to actuate the flow disabler to a closed position. The second control algorithm is preferably operable independently of the first control algorithm responsible for energizing fuel injectors 30. In a preferred embodiment, the first control algorithm may continue to signal fuel injection events in all of fuel injectors 30, even though fuel flow to one or more of injectors 30 may be blocked by flow disablers 40.

It is contemplated that actuating of flow disablers 40 may occur either manually or automatically. In contrast to an embodiment wherein a control algorithm is operable to energize flow disablers 40, a vessel operator or engineer may manually energize (or de-energize) one or more electrical actuators of flow disablers 40 when notified of a fault, for instance, by the sounding of an alarm to disable fuel flow to a respective cylinder.

Electronic control module 16 is further preferably configured to record data relating to various engine operating parameters, particularly such parameters as are associated with the development of a fault condition, along with the engine operating window during which the fault occurs. Accordingly, it will be possible for an operator to assess various engine conditions that led to the fault condition, determine which cylinders are shut down, and make a decision as to whether and when the cylinders and associated fuel injectors may be restarted. In a preferred embodiment, injection of fuel to a particular cylinder is re-initiated by de-actuating the flow disabler associated with the particular cylinder, preferably by manual control. Once actuator 44 is de-energized, valve member 41 can return to its open position under the action of biasing spring 49. Further embodiments are contemplated wherein a latching means is provided with each of flow disablers 40. In such a design, upon energizing flow disabler 40, valve member 41 will latch at its closed position such that if actuator 49 is inadvertently de-energized, valve member 41 will not return to its open position. The latching means may be manually or automatically disengaged.

The present disclosure therefore provides a means for selectively shutting down the firing of one or more of the engine cylinders, allowing the fuel injectors, pistons and valves associated therewith to continue to operate passively. The risk of engine damage and/or failure is thereby minimized. Moreover, it is unnecessary to shut down the entire engine upon detecting a fault, or continue operating out-of-specification cylinders, allowing the engine to continue to operate.

The present description is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. While the present disclosure has been described in the context of a large diesel engine marine vessel, other smaller engines may benefit from the teachings herein. For example, smaller diesel or gasoline engines having high pressure feed lines or common rails may be well suited to electronically controlled flow disablers, as described herein. Other aspects, features and advantages will be apparent upon an examination of the attached drawing figures and appended claims.

What is claimed is:

1. An internal combustion engine comprising:

a high pressure feed line;

a plurality of fuel injectors fluidly connected to said high pressure feed line, each of said fuel injectors being operable to inject a fuel into said engine;

an electronically controlled flow disabler disposed between said high pressure feed line and a fuel injection control valve of each one of said fuel injectors, each said flow disabler including an actuator operable to move a valve member from a first position, at which said valve member permits fuel flow from said high pressure feed line to the respective fuel injector, to a closed position at which said valve member blocks fuel flow from said high pressure feed line;

a biasing means biasing said valve member toward said first position; and means for manually energizing each of said electronically controlled flow disablers to block a fuel flow to the respective fuel injector.

2. An internal combustion engine comprising:

a high pressure feed line;

a plurality of fuel injectors fluidly connected to said high pressure feed line, each of said fuel injectors being operable to inject a fuel into said engine;

an electronically controlled flow disabler disposed between said high pressure feed line and a fuel injection control valve of each one of said fuel injectors, each said flow disabler including an actuator operable to move a valve member toward a closed position at which said flow disabler blocks a fuel flow to the respective fuel injector;

wherein each of said electronically controlled flow disablers is located outside of a respective injector body;

wherein said valve member is movable between a first position at which said valve member permits fuel flow from said high pressure feed line, and a second position at which said valve member blocks fuel flow from said high pressure feed line;

said engine further comprising a biasing means biasing said valve member toward said first position; and said engine further comprising an electronic control module in control communication with each of said electronically controlled flow disablers, and a fuel type control valve configured to control a fuel type supplied to said high pressure feed line.

3. The engine of claim 2 wherein said control module comprises:

a computer readable medium having a control algorithm recorded thereon, said control algorithm including means for monitoring an engine speed and for controlling an operation of each of said plurality of fuel injectors, including means for continuing signaling fuel injection events in each of said fuel injectors separately from operation of said flow disablers.

4. The engine of claim 3 wherein said control algorithm is a first control algorithm, said computer readable medium further including a second control algorithm recorded thereon, said second control algorithm operable independently of said first control algorithm and including means for selectively activating each of said electronically controlled flow disablers upon the detection of a fault.

5. An internal combustion engine comprising:

a high pressure feed line;

a plurality of fuel injectors fluidly connected to said high pressure feed line, each of said fuel injectors being operable to inject a fuel into said engine;

an electronically controlled flow disabler disposed between said high pressure feed line and a fuel injection control valve of each one of said fuel injectors, each said flow disabler including an actuator operable to move a valve member toward a closed position at which said flow disabler blocks a fuel flow to the respective fuel injector;

a first tank containing a first fuel type having a first viscosity; and a second tank containing a second fuel type having a second viscosity greater than said first viscosity;

said first and second tanks being selectively connectable with said high-pressure feed line.

6. The engine of claim 5 further comprising a plurality of mechanical flow limiters operable to limit or block a fuel flow to at least one of said fuel injectors, each of said mechanical flow limiters being disposed in series with one of said electronically controlled flow disablers.

7. The engine of claim 6 wherein each of said mechanical flow limiters is operable to block fuel flow to one of said fuel injectors.

8. The engine of claim 5 comprising:

a plurality of fuel injectors each having at least one injection control valve disposed therein; and a plurality of electronically controlled flow disablers operable independently of each said at least one injection control valve to selectively block fuel flow to the respective injector.

9. A method of operating an internal combustion engine comprising the steps of:

injecting a fuel from a high pressure feed line to a plurality of engine cylinders via respective fuel injection control valves of respective fuel injectors; and disabling at least one of the engine cylinders upon the detection of a fault by selectively actuating an electronically controlled flow disabler to block a fuel flow thereto;

the disabling step includes energizing the electronically controlled flow disabler in a fuel supply to the at least one cylinder to move a valve member from an open position toward a closed position;

wherein the step of injecting a fuel comprises selecting one of a first fuel having a first viscosity and a second fuel having a second viscosity greater than said first viscosity, and further comprising the step of:

supplying the selected first or second fuel to the engine.

10. The method of claim 9 wherein the detection of a fault comprises detection of out-of-specification operation of the at least one engine cylinder.

11. The method of claim 10 further comprising the step of:

monitoring plural engine operating parameters with an electronic control module, the electronic control module including a control algorithm recorded thereon having means for actuating the electronically controlled flow disabler upon detection of the fault to block fuel flow to the at least one engine cylinder.

12. The method of claim 11 wherein the at least one cylinder is a disabled cylinder, and further comprising the steps of:

maintaining operation of at least one additional cylinder of the engine while the disabled cylinder is blocked from receiving fuel; and re-enabling the disabled cylinder upon clearing of the fault at least in part by de-actuating the respective electronically controlled flow disabler.

13. The method of claim 12 wherein the step of disabling at least one cylinder comprises manually controlling the respective electronically controlled flow disabler to actuate to a closed position.

14. The method of claim 12 wherein the electronic control module includes means for detecting the fault, and wherein the step of disabling at least one cylinder comprises automatically actuating the respective electronically controlled flow disabler with the electronic control module upon the detection of the fault.

15. The method of claim 10 comprising the step of:

monitoring a plurality of engine operating parameters with an electronic control module; and recording on a computer readable medium with the electronic control module engine data corresponding to an operating window during which the fault and the disabling step occurred.

16. An internal combustion engine comprising:

a high pressure feed line;

a plurality of fuel injectors fluidly connected to said high pressure feed line, each of said fuel injectors being operable to inject a fuel into said engine;

an electronically controlled flow disabler disposed between said high pressure feed line and a fuel injection control valve of each one of said fuel injectors, each said flow disabler including an actuator operable to move a valve member toward a closed position at which said flow disabler blocks a fuel flow to the respective fuel injector; and a plurality of mechanical flow limiters operable to limit or block a fuel flow to at least one of said fuel injectors, each of said mechanical flow limiters being disposed in series with one of said electronically controlled flow disablers.

* * * * *